US009382043B2

(12) United States Patent
Rummo

(10) Patent No.: US 9,382,043 B2
(45) Date of Patent: Jul. 5, 2016

(54) RECLOSABLE BAG MADE OF A PAPER-PLASTIC LAMINATE

(71) Applicant: Cosimo Rummo, Benevento (IT)

(72) Inventor: Cosimo Rummo, Benevento (IT)

(73) Assignee: RUMMO S.P.A., Benevento (IT)

( * ) Notice: Subject to any disclaimer, the term of this patent is extended or adjusted under 35 U.S.C. 154(b) by 0 days.

(21) Appl. No.: 14/376,525

(22) PCT Filed: Mar. 4, 2013

(86) PCT No.: PCT/IT2013/000064

§ 371 (c)(1),
(2) Date: Aug. 4, 2014

(87) PCT Pub. No.: WO2013/136352

PCT Pub. Date: Sep. 19, 2013

(65) Prior Publication Data

US 2015/0016758 A1 Jan. 15, 2015

(30) Foreign Application Priority Data

Mar. 12, 2012 (IT) ..... NA2012A0010

(51) Int. Cl.

| | |
|---|---|
| ***B65D 33/04*** | (2006.01) |
| ***B65D 75/52*** | (2006.01) |
| ***B65D 75/58*** | (2006.01) |
| ***B65D 33/16*** | (2006.01) |

(Continued)

(52) U.S. Cl.

CPC ..... *B65D 33/04* (2013.01); *B65D 33/1691* (2013.01); *B65D 33/24* (2013.01); *B65D 75/522* (2013.01); *B65D 75/58* (2013.01); *B65D 85/22* (2013.01)

(58) Field of Classification Search

CPC ..... B65D 27/04; B65D 65/16; B65D 65/18; B65D 33/22; B65D 31/10; B65D 33/20; B65D 31/02; B65D 33/24; B65D 33/30; B65D 33/04; B65D 33/1691; B65D 75/522; B65D 75/58; B65D 85/22

USPC ..... 383/84–86, 88

See application file for complete search history.

(56) References Cited

U.S. PATENT DOCUMENTS

| | | | |
|---|---|---|---|
| 1,814,685 | A | 7/1931 | Glass |
| 1,970,848 | A | 8/1934 | Grant |

(Continued)

FOREIGN PATENT DOCUMENTS

| | | | |
|---|---|---|---|
| FR | 2 890 941 | A1 | 3/2007 |
| WO | 01/22839 | A1 | 4/2001 |

OTHER PUBLICATIONS

International Search Report, dated Sep. 6, 2013, from corresponding PCT application.

*Primary Examiner* — Nathan J Newhouse
*Assistant Examiner* — Peter Helvey
(74) *Attorney, Agent, or Firm* — Young & Thompson

(57) ABSTRACT

A reclosable bag (1) made of a paper-plastic laminate, having a rear side (8) and upper and lower heat-sealed edges (3, 4), comprises an external layer (5) made of paper and an inner polymeric lining film (7). A rear window (9) closed by the inner polymeric lining film (7) is formed in the external paper layer (5) on the rear side (8) of the bag (1). An easy open adhesive label (10) is permanently attached through a first portion (11) thereof on the external paper layer (5) of the upper edge (3) of the bag (1), and through a second portion (12) thereof releasably on the internal polymeric lining film (7) that closes the rear window (9).

7 Claims, 3 Drawing Sheets

(51) Int. Cl.
*B65D 33/24* (2006.01)
*B65D 85/22* (2006.01)

(56) References Cited

U.S. PATENT DOCUMENTS 2,158,755 A * 5/1939 Hodgdon et al. ..... 428/191
2,752,085 A * 6/1956 Bryce ..... 383/106
3,038,651 A 6/1962 Cloudsley
3,870,221 A * 3/1975 Zeitter ..... 229/162.7
5,326,575 A * 7/1994 Spaulding ..... 426/87
5,772,331 A * 6/1998 Irace et al. ..... 383/90
6,033,114 A 3/2000 Grimm et al.
6,701,654 B2 * 3/2004 Rappaport et al. ..... 40/776
7,750,274 B2 * 7/2010 Carre ..... 219/725
2002/0088730 A1 * 7/2002 Galomb ..... 206/459.5
2003/0035598 A1 2/2003 Hiraiwa et al.
2004/0076347 A1 * 4/2004 Johnson ..... 383/106
2005/0274780 A1 * 12/2005 Charlton ..... 229/164.1
2013/0022714 A1 * 1/2013 Coderre ..... 426/106

* cited by examiner

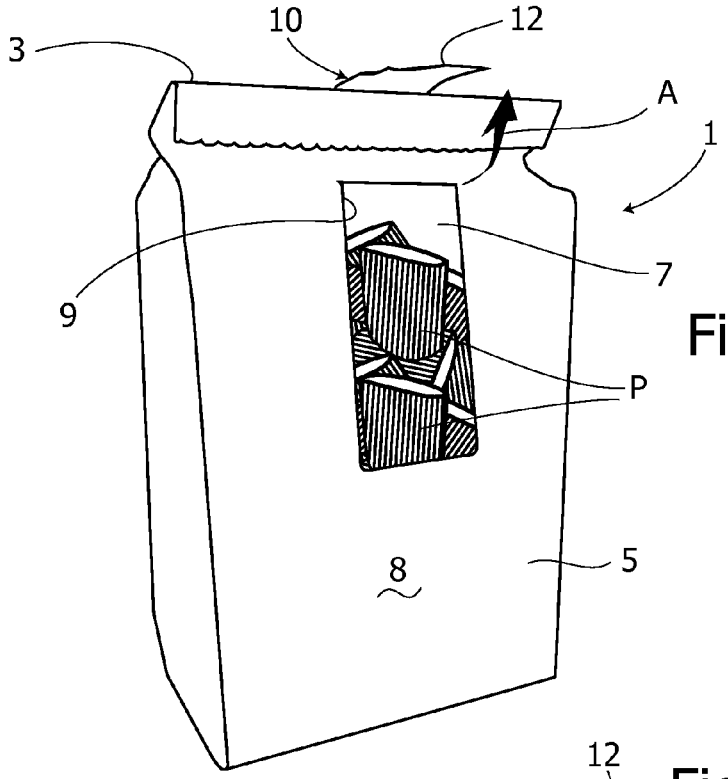
Fig. 3
Fig. 4
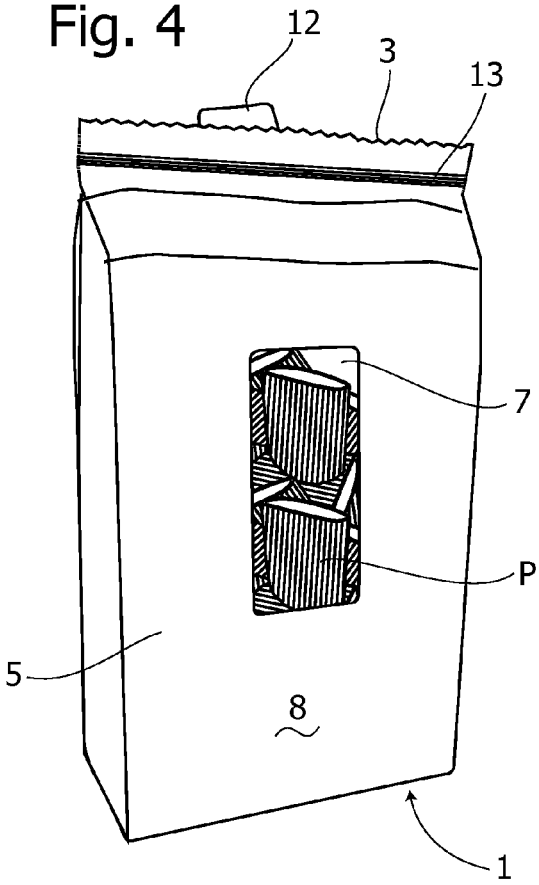
Fig. 5
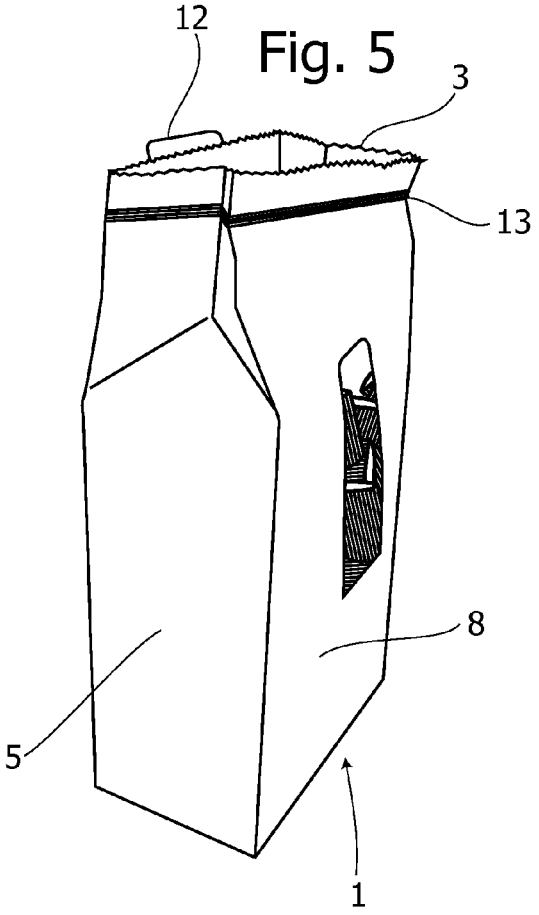

RECLOSABLE BAG MADE OF A PAPER-PLASTIC LAMINATE

TECHNICAL FIELD

The present invention relates to a reclosable bag made of paper-plastic laminate. In a bag of this kind a layer of paper generally provides an external printable surface, and the polymeric film layer gives a barrier protection.

BACKGROUND ART

Paper bags having an inner polymeric lining film, have existed for a long time. U.S. Pat. No. 3,038,651 that was granted on 12 Jun. 1962, may be mentioned by way of example. Said patent describes a paper bag comprising a paper tubular outer layer having a window therein, and a cellophane tubular inner liner attached to the outer tubular layer by means of an adhesive. The window is closed only by the cellophane inner liner, which allows the product contained inside the bag to be seen. The bag has a perforation line in the vicinity of its sealed upper edge. The consumer opens the bag by tearing it away along the perforation line. If the product, for example cookies, is not consumed all at once after opening the bag, the consumer is recommended according to the cited patent to fold the remaining upper edge so as to tightly close the bag to reduce the possibility that the product becomes stale because of the contact with the air.

The technique of obtaining in the front of the bag by appropriate die cutting at least one window for direct vision of the product when the bag is, for example, exposed to the public on the shelf of a store, is already well known from the above mentioned U.S. Pat. No. 3,038,651 and widely spread in the distribution. All these bags have the same problem of not being able to be reliably sealed after the first opening and a partial consumption of the contents.

Also food bags, which are normally used to contain a sealed dry pasta, are very widespread in the distribution of goods; such food bags are constituted by a single polymeric generally transparent tubular layer, for example made of polypropylene, partially printed with the name, the characteristics of the contained product and more. The bag is heat sealed to the upper and lower edges. An easy open removable adhesive label is attached in many cases on the upper edges, that the consumer has to tear or cut to get to the contents. This adhesive label must be removed to open the bag and attached again to join the upper edges of the bag with a side of the latter: this allows the bag to be closed after removal of a part of its contents, the remaining part thereof being preserved from moisture and other external factors and prevented to spill out of the bag.

The use of an easy open adhesive label has not been hitherto possible to the bags having at least two layers, that are paper or similar material on the outside and an inside polymeric layer. In fact, if doing so, at the first removal of the adhesive label in order to open the bag, part of the paper that constitutes the outer layer of the bag would remain attached to the adhesive label. This would prevent the adhesive label to be attached again to the bag when one wants to close the bag after having partially taken out its contents. In the past, attempts have been made to solve this problem by using special glues suitable for allowing adhesion to normal papers or by using special papers such as silicone papers for obtaining a releasable adhesion of the two parts by normal glues of the adhesive labels. However it is seen that the use of special glues or papers in normal bags would have resulted in unacceptable increases in the cost of packaging of the products.

In this sense, the present invention makes possible to use adhesive labels with normal glues and a normal type of paper with a result of optimizing also industrial production costs.

Solving the above mentioned problem is important. Recently the use of bags that are only made of paper and intended to contain pasta being produced by traditional techniques has come back into favor. Paper printed with graphic elements that remind of the good old days makes more attractive the purchase and greater the reputation of the producers. Among other things, in the absence of the coating paper, the direct molding of the polymeric transparent layer creates an ineffective mixture between printing elements and contents of the bag.

DISCLOSURE OF THE INVENTION

In this context, the technical task underlying the present invention is to propose a reclosable bag made of paper-plastic laminate which overcomes the drawbacks of the prior art mentioned above. In particular, an object of the present invention is to allow the utilisation of an easy open adhesive label also in a bag externally made of paper or paper material, for the aforesaid advertising and commercial reasons.

The mentioned technical task and the specified objects are substantially achieved by a reclosable bag made of paper-plastic laminate, having a front side, a rear side and upper and lower heat-sealed edges, the bag comprising at least an external layer of paper or similar, possibly equipped in the front side of a front window to show the contents of the bag, and an inner polymeric lining film able to close the front window, if any, in the at least one external layer of paper, in which formed in the at least one external paper layer on the rear side of the bag is a rear window closed by the inner polymeric lining film, and an easy open adhesive label is permanently attached with its first portion on the paper layer of the upper edge of the bag and with its second portion in a releasable manner on the inner polymeric lining film that closes the rear window.

BRIEF DESCRIPTION OF DRAWINGS

Further characteristics and advantages of the present invention will be more clear from the indicative description, and therefore non-limiting, of a preferred not exclusive embodiment of a reclosable bag made of paper-plastic laminate, as illustrated in the accompanying drawings in which:

FIGS. 3 to 7 are perspective views from above and substantially from behind of the bag in FIG. 1 in subsequent steps of opening and closing of the bag after removing part of its contents.

BEST MODE FOR CARRYING OUT THE INVENTION

Figure 1:
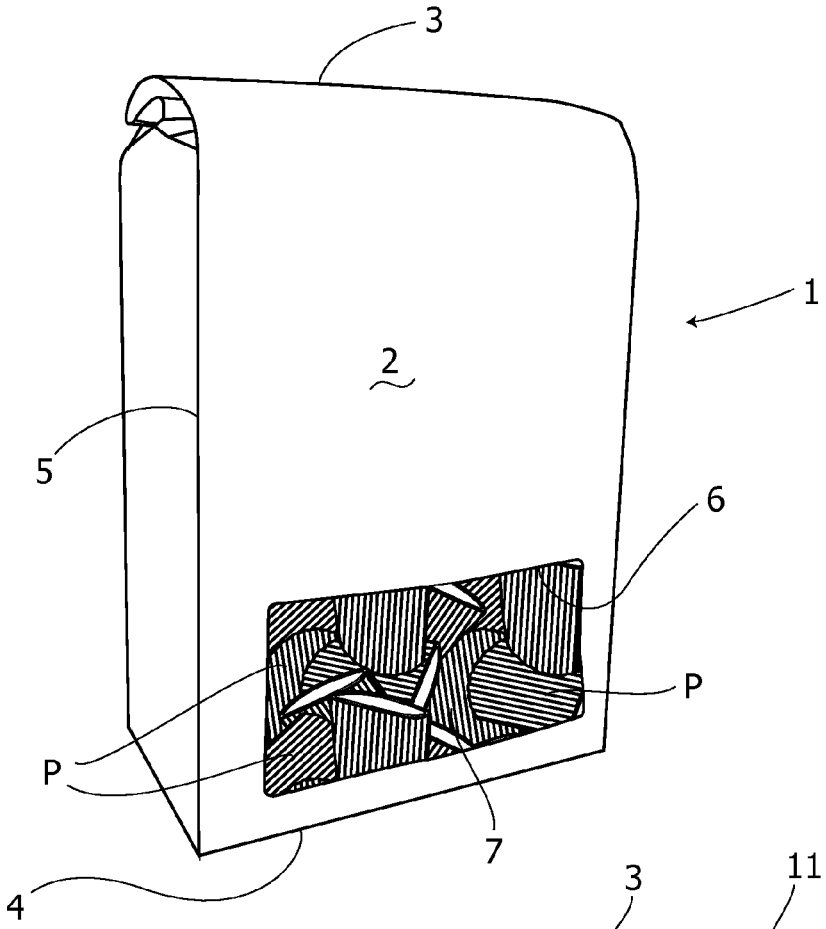
FIG. 1 is a perspective view from above and from the front of a bag in which the present invention is embodied.

Referring to FIG. 1, represented in a perspective view from above and from the front is a bag 1 in which features of the present invention are embodied. The bag 1 as represented in FIG. 1 could be of a conventional type. The bag 1 has a front side 2 and upper and lower edges 3, 4. The edges 3 and 4 are heat-sealed, but in the following figures only the heat-sealing of the upper edges is shown. The bag 1 comprises at least an external layer 5 made of paper or similar. The external layer 5 is provided with a front window 6 in its front side in order to show the contents of the bag, e.g. pasta P. The front window 6 is closed by an inner polymeric lining film 7 that is laminated on the external paper layer 5, which can be also considered as a single-ply layer for convenience's sake in the description below.

Figure 2:
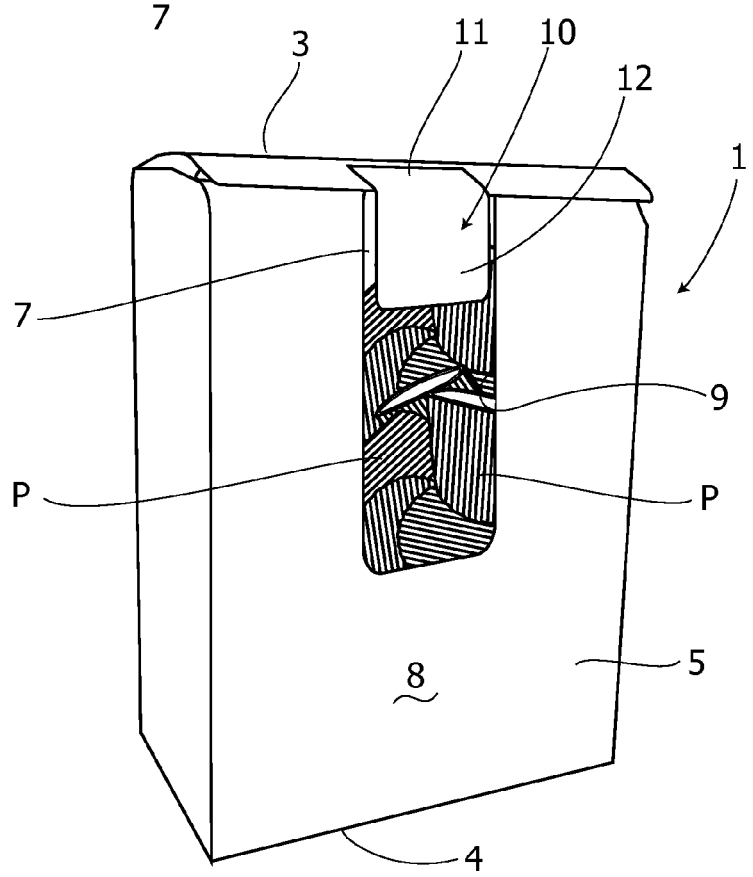
FIG. 2 is a perspective view from above and from behind of the bag in FIG. 1 according to the present invention.
Figure 6:
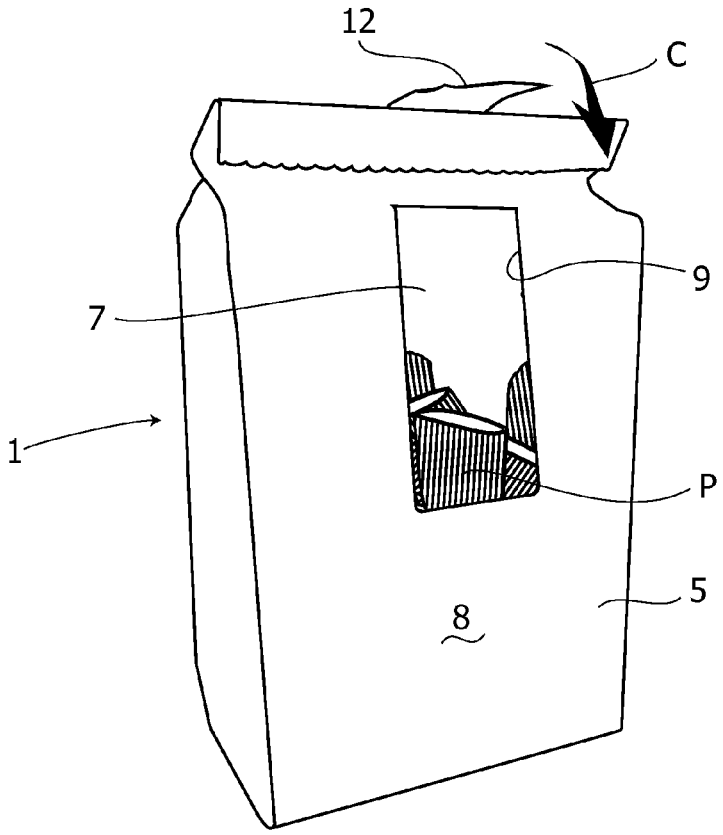
Figure 7:
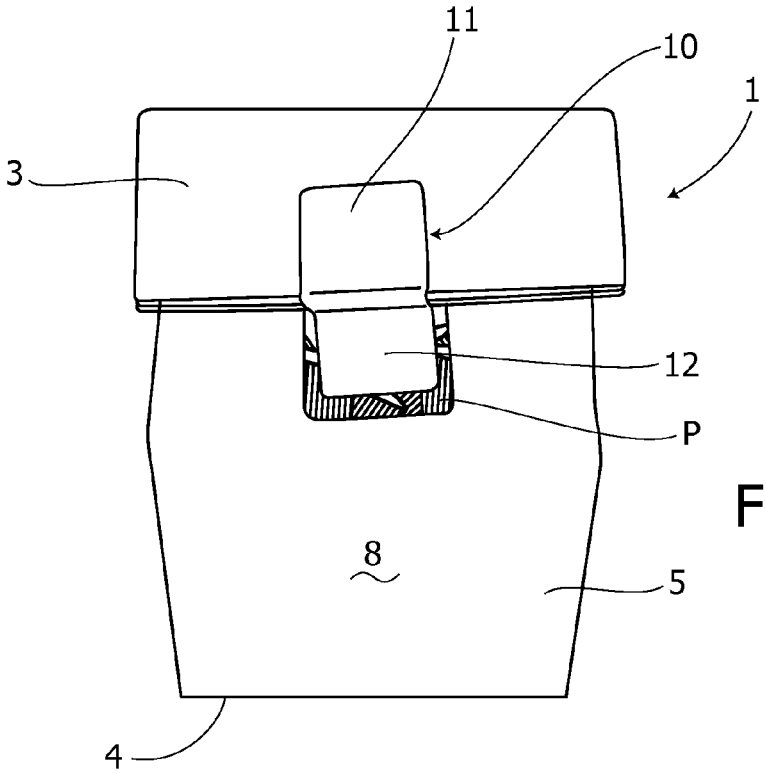

Referring to FIG. 2, which is a perspective view from above and from behind of the bag in FIG. 1 according to the present invention, a rear window 9 is shown formed on the rear side 8 of the bag in the external paper layer 5 which delimits the visible part of the inner polymeric lining film 7.

In order to allow the bag to be repeatedly opened and closed according to the invention, an adhesive label 10 is used. As is known, the easy open adhesive labels have an adhesive layer on the active side for the connection between two parts in a bag, adhesive layer which, if it is not soiled by contact with the hands or with foreign substances, allows a bag to be opened and closed several times. This is currently possible only when the bags on which the adhesive labels are attached are of a plastic substance suitable such as polypropylene, whereby a contact with the plastic substance does not alter the effectiveness of the adhesive layer.

The easy open adhesive labels can not be used with either paper bags or bags provided with a paper layer outside, because their adhesive layer, when opening and closing, would bring with it part of the paper of the bag, and the label would immediately lose its ability to reattach itself to the paper layer of the bag.

According to the present invention, the problem of opening and closing several times a bag provided with a layer 5 of paper outside has been overcome thanks to the fact that formed on the rear side 8 of the bag is the rear window 9 in the outer layer 5 made of paper. The rear window 9 is closed with the inner polymeric lining film 7 that lines the bag 1 internally. It should be understood that, for the purposes of the present invention, it is not necessary that the film covers completely the interior of the bag, but that it simply closes the windows.

The adhesive label 10 is attached in a permanent manner with its first portion 11 to the upper edge 3 of the bag 1. On the rear window 9 a second portion 12 of the adhesive label 10 is releasably applied on the opposite side to the first portion 11 of the same adhesive label 10, said first portion 11 being permanently attached to the paper layer 5 on an upper edge 3 of the bag.

Therefore, the rear window 9 has not been made to show the contents of the bag, but to allow the second portion 12 of adhesive label to adhere, i.e. the one intended to stick on the rear side 8 of the bag. The size of the rear window 9 in the direction of the width is slightly greater than the width of the adhesive label, so as to easily receive the latter, without the risk of being superimposed with the paper layer 5, and consequently losing its adhesiveness. The size of the rear window 9 in the direction of the length is such as to allow the positioning at different heights of the second portion 12 of the adhesive label 10 so as to stick in any position corresponding to the progressive decrease of the contained product.

Shown in FIGS. 3 to 7 are perspective views from above and substantially from behind, unless otherwise specified hereinafter, of the bag of FIG. 1 in successive steps of opening and closing after partial removal of its contents.

In particular, shown in FIG. 3 is a view subsequent to that of FIG. 2 where the second portion 12 of the adhesive label 10 is detached from the polymeric lining film 7 that closes the rear window 9 of the paper layer 5, the adhesive label 10 remaining permanently attached with its first portion 11 (FIG. 2) on the upper edge 3 of the bag 1. As shown in FIG. 4, which is a view similar to that of FIG. 3, the upper edge 3 is turned upward as indicated by the arrow A in FIG. 3. In FIG. 4 indicated as 13 is the heat sealing which seals the upper edges of the bag, the bag being shown opened in FIG. 5 which is a three-fourths perspective view of the same. After the partial removal of the contents of the bag, the upper edge 3 is folded downward according to arrow C (FIG. 6) and the second portion 12 of the adhesive label 10 is reattached to the desired height in the polymeric layer 7 which closes the rear window 9 of the paper layer 5. This is clearly shown in the perspective view from the front and from above in FIG. 7.

The advantages provided by the invention should be evident.

So far the easy open adhesive label could not be used in the bags, and generally in paper packages, because if applied at the time of packaging, and lifted, even partially, for the removal of contents from a bag, it could not be reapplied to close the bag. Actually in many packaging the adhesive label is still used as an anti-tamper protection, since the absence or the partial lifting of the adhesive label can be evidence to prove that the package could be no more intact.

It is clear that in packaging which must however remain sealed such as bags for pasta, in which the sealing is obtained by heat sealing, the possibility of maintaining the contents of bags protected after their first opening until complete consumption of the product, already provided to the polypropylene bags, becomes a significant added value for paper bags, which are a way of packing more and more widespread in the distribution of food products.

This result is to be considered particularly effective if combined with the fact that it has been obtained without having to resort to particular materials, such as papers and particular films, or glues with special adhesive power.

With regard to other features of the invention described above, it should be understood that the height dimension of the rear window 9 is not binding and can be chosen in such a way as to allow a proper closure for each minimum contents of the bag.

Other modifications and variations are possible, all within the scope of the attached claims.

The invention claimed is:

1. A re-closable bag (1) made of a paper-plastic laminate, comprising:

an external layer of paper (5);

an inner polymeric lining film (7);

a front side (2) comprised of at least the external layer of paper (5);

a rear side (8) comprised of at least the external layer of paper (5);

upper and lower heat-sealed edges (3, 4) comprised of the external layer of paper (5);

a rear window (9) located in the external layer of paper (5) on the rear side (8) the rear window (9) being closed by the inner polymeric lining film (7); and an easy open adhesive label (10) with i) a first portion (11) permanently attached on the external layer of paper (5) of the upper edge (3) of the bag (1) and ii) a second portion (12) releasably attached on a part of the inner polymeric lining film (7) that closes the rear window (9), the easy open adhesive label being reusable against the inner polymeric lining film that closes the rear window (9) of the re-closable bag, wherein, the easy open adhesive label has an adhesive layer on an active side and provides a connection between i) the external layer of paper layer (5) of the upper edge (3) of the bag (1) and ii) the part of the inner polymeric lining film (7) that closes the rear window (9), the adhesive layer allowing the bag to be opened and closed plural times, and a width of the rear window (9) is greater than a width of the easy open adhesive label located over the rear window such that the easy open adhesive label (10) is attached only to the external layer of paper (5) of the upper edge (3) of the bag (1) and the part of the inner polymeric lining film (7) that closes the rear window (9), and wherein removal of the second portion of the adhesive label from the inner polymeric lining film (7) that closes the rear window (9) is required to open the sealed upper edges of the bag and re-adhering the second portion of the adhesive label on the inner polymeric lining film (7) that closes the rear window (9) again joins the upper edges to the rear side of the bag.

2. The re-closable bag according to claim 1, wherein the inner polymeric lining film (7) is made of polypropylene.

3. The re-closable bag according to claim 1, wherein contact of the adhesive layer on the inner polymeric lining film (7) does not alter the effectiveness of the adhesive layer.

4. The re-closable bag according to claim 1, wherein the inner polymeric lining film (7) does not completely cover an interior side of the external layer of paper (5), and is limited to a region of the interior side of the external layer of paper (5) that closes the rear window.

5. The re-closable bag according to claim 1, further comprising at least one further window in addition to the rear window (9), each further window located in the external layer of paper (5) and closed by the inner polymeric lining film (7), wherein the inner polymeric lining film (7) does not completely cover an interior side of the external layer of paper (5) and is limited to region of the interior side of the external layer of paper (5) that closes the rear window and each further window.

6. A re-closable bag (1) made of a paper-plastic laminate, comprising:

an external layer of paper (5);

an inner polymeric lining film (7);

a front side (2) comprised of at least the external layer of paper (5);

a rear side (8) comprised of at least the external layer of paper (5);

upper and lower heat-sealed edges (3, 4) comprised of the external layer of paper (5);

a rear window (9) located in the external layer of paper (5) on the rear side (8) the rear window (9) being closed by the inner polymeric lining film (7); and an easy open adhesive label (10) with i) a first portion (11) permanently attached on the external layer of paper (5) of the upper edge (3) of the bag (1) and ii) a second portion (12) releasably attached on a part of the inner polymeric lining film (7) that closes the rear window (9), the easy open adhesive label being reusable against the inner polymeric lining film that closes the rear window (9) of the re-closable bag; and a front window (6) located in the external layer of paper (5) on the front side (2), wherein, the front window (6) is closed by the inner polymeric lining film (7), the easy open adhesive label has an adhesive layer on an active side and provides a connection between i) the external layer of paper layer (5) of the upper edge (3) of the bag (1) and ii) the part of the inner polymeric lining film (7) that closes the rear window (9), the adhesive layer allowing the bag to be opened and closed plural times, a width of the rear window (9) is greater than a width of the easy open adhesive label, and the inner polymeric lining film (7) covers only parts of an interior side of the external layer of paper (5), and includes a first inner polymeric lining film region that closes the rear window and a separate second inner polymeric lining film (7) that closes the front window, wherein areas of the external layer of paper (5) between the first and second inner polymeric lining film regions are free of the inner liner film (7).

7. A re-closable bag (1) made of a paper-plastic laminate, comprising:

an external layer of paper (5) defining a front bag side (2) and a rear bag side (8), the external layer of paper (5) having upper and lower edges that are heat-sealed;

an inner polymeric lining film (7) covering only portions of the external layer of paper;

at least one window (9) located in the external layer of paper (5) and closed by the inner polymeric lining film (7); and a reusable, easy open adhesive label (10) with an adhesive layer that joins the upper edges of the external layer of paper (5) to the inner polymeric lining film (7) that closes the at least one window (9), the easy open adhesive label (10) being comprised of i) a first portion (11) permanently attached, via a first portion of the adhesive layer, on the upper edge (3) of the external layer of paper (5), and ii) a second portion (12) releasably attached, via a second portion of the adhesive layer, on a part of the inner polymeric lining film (7) that closes the at least one window (9), the easy open adhesive label being reusable against the inner polymeric lining film that closes the at least one window (9), the adhesive layer being reusable against the inner polymeric lining film that closes the at least one window (9) allowing the bag to be opened and closed plural times, wherein, removal of the second portion of the adhesive label from the inner polymeric lining film (7) that closes the at least one window (9) is required to open the sealed upper edges of the bag and re-adhering the second portion of the adhesive label on the inner polymeric lining film (7) that closes the at least one window (9) again joins the upper edges of the external layer of paper (5) to the inner polymeric lining film (7) that closes the at least one window (9).

* * * * *